US009637885B2

(12) United States Patent
Lokkinen

(10) Patent No.: US 9,637,885 B2
(45) Date of Patent: May 2, 2017

(54) SAFETY DEVICE FOR USE IN WELL

(71) Applicant: Picote Oy Ltd., Porvoo (FI)

(72) Inventor: Mika Lokkinen, Porvoo (FI)

(73) Assignee: PICOTE OY LTD., Porvoo (FI)

( * ) Notice: Subject to any disclaimer, the term of this patent is extended or adjusted under 35 U.S.C. 154(b) by 0 days.

(21) Appl. No.: 14/906,338

(22) PCT Filed: Jul. 22, 2014

(86) PCT No.: PCT/FI2014/050588

§ 371 (c)(1),
(2) Date: Jan. 20, 2016

(87) PCT Pub. No.: WO2015/015050

PCT Pub. Date: Feb. 5, 2015

(65) Prior Publication Data

US 2016/0168817 A1 Jun. 16, 2016

(30) Foreign Application Priority Data

Jul. 29, 2013 (FI) ..... 20135799

(51) Int. Cl.

| | |
|---|---|
| ***E02D 29/12*** | (2006.01) |
| ***E01F 13/02*** | (2006.01) |
| ***E01F 15/14*** | (2006.01) |
| ***E02D 29/14*** | (2006.01) |

(52) U.S. Cl.

CPC ..... *E02D 29/127* (2013.01); *E01F 13/02* (2013.01); *E01F 15/14* (2013.01); *E02D 29/122* (2013.01); *E02D 29/14* (2013.01); *E02D 29/1481* (2013.01)

(58) Field of Classification Search

CPC ..... E01F 13/02; E01F 15/04; E02D 29/127; E02D 29/14; E02D 29/1481; E02D 29/122

See application file for complete search history.

(56) References Cited

U.S. PATENT DOCUMENTS 1,688,074 A * 10/1928 Goff ..... E01F 13/02 160/135
1,741,323 A * 12/1929 Lufkin ..... E01F 13/02 160/135

(Continued)

FOREIGN PATENT DOCUMENTS

| | | |
|---|---|---|
| BE | 1007343 | 5/1995 |
| CN | 201972168 | 9/2011 |

(Continued)

OTHER PUBLICATIONS http://innova2000.ca/media/uploads/products/specs-en/da2219-01_ang_2.pdf (Dec. 4, 2009).

*Primary Examiner* — Abigail A Risic
(74) *Attorney, Agent, or Firm* — Fasth Law Offices; Rolf Fasth

(57) ABSTRACT

The safety device is to be installed in a well. The safety device is has a support structure that is arranged to be lowered at least partly into the well and that restricts the movement of the safety device in the horizontal direction. A collar is in connection with the support structure and arranged to be set against the ground to restrict the movement of the safety device in the vertical direction, with a protective structure arranged on the collar to define a safe working area around the well.

7 Claims, 1 Drawing Sheet

(56) References Cited

U.S. PATENT DOCUMENTS

| | | | | | |
|---|---|---|---|---|---|
| 1,882,150 | A * | 10/1932 | Kent | E01F 13/02 | 160/135 |
| 1,926,696 | A * | 9/1933 | Murphy | E06C 7/16 | 182/106 |
| 3,177,925 | A * | 4/1965 | Miller | E01F 13/02 | 160/114 |
| 3,444,793 | A * | 5/1969 | Pelsue | E01F 13/02 | 404/25 |
| 3,525,290 | A | 8/1970 | Pelsue | | |
| 3,810,482 | A * | 5/1974 | Beavers | E04H 15/48 | 135/147 |
| 5,295,557 | A * | 3/1994 | Taylor | E02D 29/12 | 182/113 |
| 5,941,024 | A * | 8/1999 | Journault | E02D 29/12 | 182/112 |
| 6,607,053 | B1 * | 8/2003 | Warren | E06C 7/182 | 182/106 |
| 6,669,402 | B1 | 12/2003 | Davis | | |
| 7,931,122 | B2 * | 4/2011 | Grandy | E02D 29/12 | 182/128 |
| 8,522,487 | B2 * | 9/2013 | Whiting | E05B 47/02 | 52/19 |
| 8,726,577 | B2 * | 5/2014 | Whiting | E04D 13/0335 | 256/25 |
| 2002/0124786 | A1 * | 9/2002 | Perkins | E02D 29/12 | 114/201 R |
| 2006/0054773 | A1 | 3/2006 | Vetesnik | | |
| 2007/0248410 | A1 | 10/2007 | McCue | | |
| 2009/0236180 | A1 * | 9/2009 | Grandy | E02D 29/12 | 182/128 |
| 2010/0299999 | A1 * | 12/2010 | Pizzolato | E02D 29/12 | 49/380 |
| 2013/0255122 | A1 * | 10/2013 | Henderson | E01F 13/02 | 40/606.03 |

FOREIGN PATENT DOCUMENTS

| | | |
|---|---|---|
| FR | 2689152 | 10/1993 |
| JP | 2001098573 | 4/2001 |
| JP | 2002220820 | 8/2002 |
| WO | 9946515 | 9/1999 |

* cited by examiner

SAFETY DEVICE FOR USE IN WELL

PRIOR APPLICATIONS

This is a US national phase patent application that claims priority from PCT/FI2014/050588 filed 22 Jul. 2014, that claims priority from Finnish Patent Application No. 20135799, filed 29 Jul. 2013.

BACKGROUND OF THE INVENTION

The invention relates to a safety device used in a well, such as an inspection well.

Especially in urban areas, there is a great deal of piping below the ground for rain water, sewage waste or data transmission cables, for instance. Typically the piping is built below the street network so that, for rain water, there are vertical pipes extending to the street level and covered with a cover that allows the rain water to flow into the piping. Correspondingly, sewers and cable pipes are equipped with vertical pipes that extend to the street level and act as inspection wells if the sewer needs to be opened or renovated or if a cable needs a new connector. Inspection wells on the streets are easy to find and reach, but working around the well is dangerous because of the passing traffic. In addition, an open inspection well causes danger to the people and vehicles passing on the street.

Prior-art solutions endeavour to attach the attention of a driver of a vehicle to the work area with safety strips, lights or fences. These help an observant driver, but do not protect the person working by the well, if, in spite of everything, a driver who is ill or drunk, for instance, does not notice the marked work area. It is also possible to use movable concrete blocks to protect the work area, but, in practice, they only help in collisions that take place at a very slow velocity, because the concrete blocks slide along with the car hitting the block. If the safety of the work area is to be ensured, a truck can be parked in front of the well to protect the work area. The use of a truck for this purpose prevents its use for its normal purposes and blocks the road from traffic on at least one traffic lane.

A problem with the above arrangement is that devices not suited for such a use take a great deal of space and may be slow to install or do not necessarily provide sufficient protection when work is ongoing by a well.

BRIEF DESCRIPTION OF THE INVENTION

Thus, an object of the invention is to develop an apparatus so as to reduce the above-mentioned problems. The object of the invention is achieved by a device characterised by what is disclosed in the independent claims. Preferred embodiments of the invention are disclosed in dependent claims.

An object of the present invention is to provide a safety device, with which it is possible to define a safe working area around a well without needlessly obstructing traffic on a street. The safety device of the invention is based on the safety device having a support structure that rests against the structure of the well and a collar that rests against the ground surrounding the well, and these two together lock the safety device to the well in such a manner that a protective structure arranged on the collar defines a safe working area around the well.

Advantages of the safety device according to the invention are fast installation and protecting structure. The safety device can be lowered from a truck, for instance, on top of the well and the installation is complete.

BRIEF DESCRIPTION OF THE DRAWINGS

The invention will now be described in more detail by means of preferred embodiments and with reference to the accompanying drawings, in which.

DETAILED DESCRIPTION OF THE INVENTION

Figure 1:
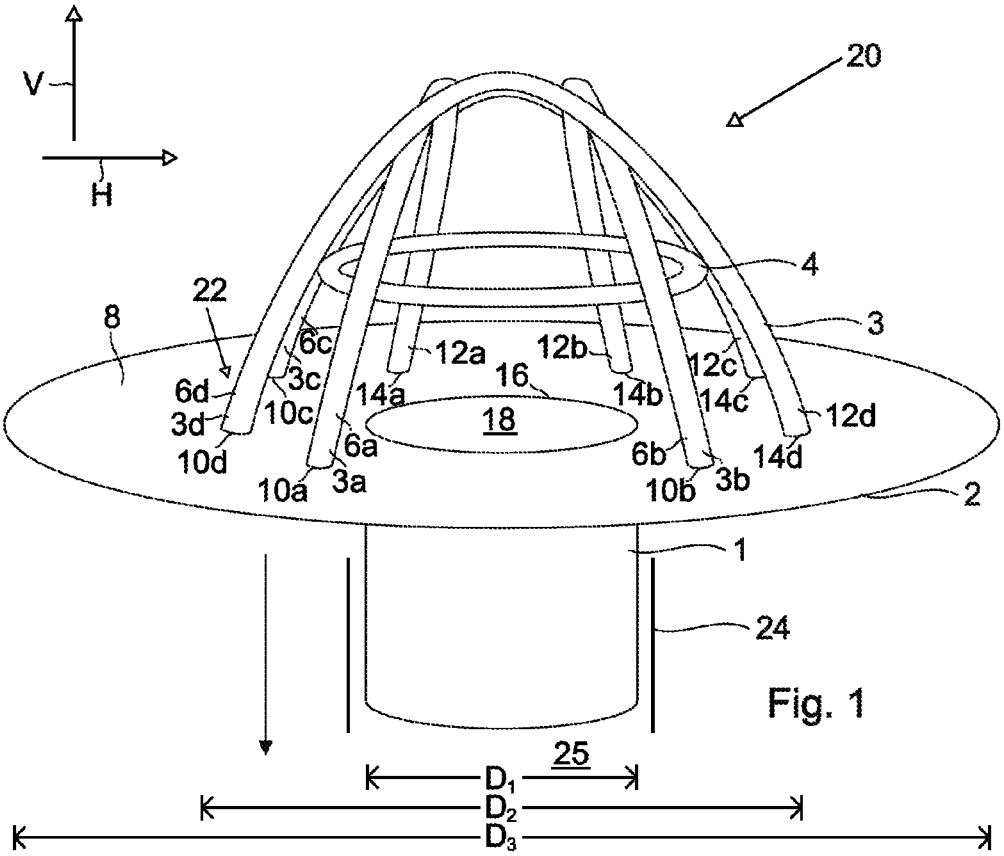
FIG. 1 shows a safety device according to an embodiment of the invention.

FIG. 1 shows a safety device according to an embodiment of the invention for installation to a well. The safety device is installed to the well by lowering it in the vertical direction shown by the arrow partly inside the vertical pipe of the well. The safety device comprises a support structure 1 that is arranged to be parallel to the vertical pipe of the well during installation to the well. The support structure 1 of the safety device is lowered into the vertical pipe of the well, in which case the support structure 1 that is dimensioned according to the vertical pipe positions the safety device in place in the sideways direction to the well. The outer surface of the support structure preferably corresponds in shape and diameter substantially to the shape and diameter of the inner surface of the vertical pipe of the well, whereby the safety device is in the horizontal direction substantially stationary when the support structure 1 is in the vertical pipe of the well. The outer diameter of the support structure is preferably slightly smaller than the inner diameter of the vertical pipe of the well so that the support structure can be easily lowered into the vertical pipe of the well.

The support structure may be a pipe comprising metal or a metal pipe, such as an iron pipe, steel pipe, or aluminium pipe, whereby a connection to the bottom of the well is maintained through the support structure 1, when the safety device is installed in the well. The cross-section of the pipe preferably corresponds to that of the vertical pipe of the well. The support structure may be a pipe with a round cross-section, for instance. In an embodiment, the support structure comprises pillars arranged on a circumference. This type of arrangement allows for small deviations in the vertical pipe of the well, such as protruding ladder steps that can be used even when the safety device is installed in the well. In an embodiment, the support structure 1 of the safety device is a pipe with a round cross-section, inside of which steps are arranged to facilitate descending in the well and ascending from it. In an embodiment, the safety device also comprises a well, with which the connection through the support structure 1 to the well can be closed between work shifts, for instance.

The support structure 1 is preferably dimensioned according to the surrounding conditions, such as traffic in the installation site and the well to be mounted. The structures of safety devices used on a pedestrian street can be made considerably lighter than those used on streets with a high speed limit. The wall thickness of the support structure can be at least 5, 10, 15, 20, 25 or 30 millimeters, for instance, depending on the material of the support structure and the use of the safety device. The length of the part of the support structure 1 lowered into the vertical pipe of the well can be at least 20, 30, 50, 75, 100 or 150 centimeters, for instance, depending on the material of the support structure and the use of the safety device. The greater the wall thickness is and the longer the support structure is, the greater impact forces the safety device withstands.

A collar 2 is arranged to the support structure 1 to stop the lowering of the safety device into the vertical pipe of the well, when the collar 2 hits the tops surface of the vertical pipe of the well or the ground surrounding the well, such as street or road. The collar 2, thus, limits the movement of the safety device in the vertical direction. The collar may be made of the same material as the support structure 1, or it may be of a different material. The collar 2 is preferably dimensioned according to the surrounding conditions, such as traffic in the installation site and the well to be mounted, as well as according to the size of the required safe working area. The thickness of the collar can be at least 5, 10, 15, 20, 25 or 30 millimeters, for instance, depending on the material or width of the collar and the use of the safety device. The width of the collar as measured from its inner edge to its outer edge can be at least 50, 75, 100, 150 or 200 centimeters, for instance, depending on the material or thickness of the collar, the required safe working area and the use of the safety device. A wide collar is preferably made thicker than a narrow collar. The collar 2 may be a circular plate in shape with an opening in the middle for access to the well surrounded by the support structure. In an embodiment, a rectangular or oval collar can be used to ensure that a collar installed in a well on a roadway does not extend to the adjacent lane. A coating increasing friction is preferably used on the top and/or bottom surface of the collar to improve safety. A rubber mat or roughened strip, for instance, may be glued or otherwise fastened to the bottom surface to keep the safety device better in place in a collision. A roughened strip or rubber mat, for instance, may be glued or otherwise fastened to the top surface, whereby the surface substantially reduces the risk of slipping, especially when the collar is wet.

A protective structure is arranged on the collar 2 to extend from it to the opposite direction in view of the support structure 1, i.e. when the safety device is installed in the well, the protective structure rises upward from the collar 2. In an embodiment, the protective structure comprises pillars 3 and railings 4 fastened to the pillars, in which case the protective structure forms a dome-like or fence-like structure that defines the safe working area around the well. The pillars and railings are preferably made of metal, such as iron, steel, aluminium, or a combination thereof, in which case, in a collision, they absorb the kinetic energy of the piece colliding with the protective structure by deforming without entirely breaking. Protective structures dimensioned for high collision loads, in particular, are preferably curved so that they direct the colliding vehicle past the protective structure, in which case the structure does not need to absorb the entire kinetic energy. An example of such a directing structure is the dome-like structure shown in FIG. 1, which is made of four curved pipes with a hoop arranged around it for reinforcement. Protective structures are preferably dimensioned according to the surrounding conditions, such as traffic in the installation site and the well to be mounted. The structures of safety devices used on a pedestrian street can be made considerably lighter than those used on streets with a high speed limit. Protective structures may be dimensioned by means of simulations and/or practical tests, for example, to be in accordance with the regulations in force, such as SFS-EN 1991-1-7 Eurocode 1, or other regulations for collision loads. In an embodiment, the safety device and protective structure are dimensioned in such a manner that when a certain piece collides at a certain velocity with the safety device, the change in the safe working area defined by the protective structure is at most of a predefined magnitude in a collision.

The protective structure may have an opening or gate for ease of access to the working area. In an embodiment, the protective structure comprises a group of vertical pillars 3 and circular railings 4 or hoops fastened to the pillars on the inside and/or outside, whereby the protective structure defines a substantially circular working area around the well. In an embodiment, the protective structure comprises vertical pillars arranged on the collar and railings between them to run crosswise from the top edge to the bottom edge and from the bottom edge to the top edge on adjacent pillars, thus, forming a lattice structure that reinforces the protective structure. In an embodiment, the protective structure also comprises support braces that extend inside and/or outside the safe working area defined by the protective structure, thus, making the protective structure stronger and stiffer. In an embodiment, a reinforced area, such as an elevated or thickened ring, is arranged on the collar for fastening the protective structures, whereby they withstand higher impact forces. In an embodiment, the safety device comprises two nested circular protective structures arranged on the collar, which may be coupled to each other or separate from each other.

The collar 2 of the safety device is preferably so big that it extends outside the protective structure 3, 4. The collar preferably extends enough outside the protective structure that in a collision, the tyre of the vehicle, such as a passenger car, van, or truck, is on top of the collar 2, when the vehicle collides with the protective structure. The force directed to the joint between the collar that is against the ground and the support structure that is in the vertical pipe of the well as well as the force caused by the support structure to the vertical pipe of the well are diminished when the tyre of the vehicle is on the collar when the vehicle collides with the protective structure. The collar may extend at least 50, 75 or 100 centimeters, for instance, outside the protective structure in at least one direction.

A safety device as described above can be used on streets intended for vehicle traffic, in which case the safety device forms a safe working area within the area defined by the protective structure. The safety device is preferably dimensioned to withstand at least a collision by a motorcycle, passenger car, van, or truck, for instance, with the protective structure at a speed corresponding to the prevailing speed limit. Devices and/or materials that attract the attention of drivers are preferably used with the safety device to reduce the risk of collision. Visual warning means, such as reflectors, lights, paints, tapings, or flags, are preferably used to attract attention. Reflective safety colours, such as yellows, oranges and reds, are preferably used.

Figure 2:
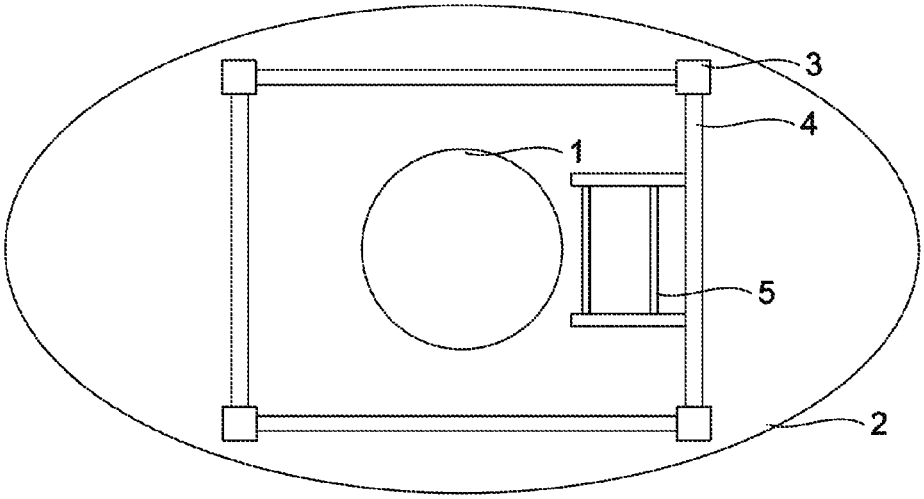
FIG. 2 is a top view of a safety device according to an embodiment of the invention.

FIG. 2 shows a safety device according to an embodiment, in which vertical pillars 3 and railings 4 connecting them are arranged on the collar 2. The collar is arranged in the shape of an oval so that the safety device would not extend outside the lane, where the well to which the safety device is installed is. The safety device has a support 5 that comprises one or more handles that the person descending into the well or ascending from it can grab to facilitate movement. The support 5 and/or its handles may be fastened to the collar and/or protective structure. In an embodiment, the protective structure is arranged at such a distance from the support structure 1 opening leading to the well that a person ascending from the well can grab the protective structure and pull him/herself out of the well.

In an embodiment, the safety device also comprises a toolbox fastened to the structures, such as protective structure and/or collar, of the safety device. The toolbox that is fastened to the structures is preferably arranged to withstand the same collisions as the rest of the structure of the safety device. The toolbox preferably has a lid or can be closed otherwise so that during a collision the tools remain in the toolbox and do not cause any risks to the persons in the safe working area or in the surroundings of the safety device. In an embodiment, the protective structures comprise means for fastening the toolbox to the protective structure, whereby the toolbox can be fastened and removed from the safety device when the worker or site changes, for instance.

The safety device may also have a weather guard, in the shape of an umbrella or canopy, for instance, that protects the area defined by the protective structure from rain and/or sun. In an embodiment, some of the pillars of the protective structure extend so high that a working space of at least standing height remains under a canopy arranged on top of them, whereby the canopy acts as a weather guard for said working space.

It is obvious to a person skilled in the art that as technology advances the basic idea of the invention may be implemented in many different ways. The invention and its embodiments are thus not restricted to the examples described above but may vary within the scope of the claims.

With reference to FIG. 1, the pillars 3 are curved and the attachment points of all the pillars 3 form a round shape around and outside a rim 16 of an opening 18 leading into an upper end of the support structure 1, attached to a bottom surface of the collar 2, and inserted into a vertical pipe 24 of a well 25. The pillars 3 are held together and supported by the circular support or railing 4. The pillars 3 and the circular railing 4 form the protective dome-shaped structure 20. More particularly, pillars 3*a*, 3*b*, 3*c*, 3*d* each has one end 6*a*, 6*b*, 6*c*, 6*d* located at attachment locations/points 10*a*, 10*b*, 10*c*, 10*d*, respectively, at a top surface 8 of the collar 2 and the opposite end 12*a*, 12*b*, 12*c*, 12*d* of each pillar, respectively, is located at attachment locations/points 14*a*, 14*b*, 14*c*, 14*d* on the top surface 8 of the collar 2 so that the curved pillars have an elongate bent semi-circular shape and form the semi-circular and dome-shaped structure 20 on top of the collar 2. The attachment points form a substantially circular shape on the top surface 8 of the collar 2. The attachment points are located around the rim 16 of the opening 18 leading into the support structure 1. In this way, the bottom of the dome-shaped structure 20, at the attachment points, forms a round or circular shape both in the horizontal (see arrow H) and vertical directions (see arrow V) so that there is no straight vertical or horizontal portion of the dome-shaped structure 20. Additionally, the circular horizontal railing 4 is attached to an inside of each pillar 3*a*, 3*b*, 3*c* and 3*d* so that the pillars and the railing together form the dome-shaped structure 20 that has a round bottom 22 with a bottom diameter (D2) greater than a diameter (D1) of the opening 18 of the support structure 1. The round collar 2 has an outer diameter (D3) that is greater than the bottom diameter (D2) of the round bottom of the dome-shaped structure 20. Pillars 3*a* and 3*b* are substantially parallel to one another and pillars 3*c* and 3*d* are also substantially parallel to one another. Preferably, pillars 3*a*/3*b* are substantially perpendicular to the pillars 3*c*/3*d*.

While the present invention has been described in accordance with preferred compositions and embodiments, it is to be understood that certain substitutions and alterations may be made thereto without departing from the spirit and scope of the following claims.

The invention claimed is:

1. A safety device to be installed in a well, comprising:

a support structure arranged to be lowered at least partly into a well and that restricts movement of the safety device in a horizontal direction;

a collar in connection with the support structure and arranged to be set against a ground to restrict movement of the safety device in a vertical direction;

a protective dome-shaped structure arranged on the collar to define a safe working area around the well;

said protective dome-shaped structure having curved pillars, each pillar having one end located at a top surface of the collar and an opposite end of each pillar being located at the top surface so that the pillars have a bent elongate semi-circular shape to form the dome-shaped structure on top of the collar;

a bottom of the dome-shaped structure forming a round or circular shape both in a horizontal and vertical direction so that there is no straight vertical portion of the dome-shaped structure; and the collar having an outer diameter (D3) being greater than a bottom diameter (D2) of the dome-shaped structure.

2. The safety device as claimed in claim 1, wherein said protective structure comprises a horizontal support fastened to the pillars.

3. The safety device as claimed in claim 1, wherein said collar extends outside the protective dome-shaped structure in such a manner that in a collision, when a vehicle collides with the protective structure, a tire of the vehicle is on top of the collar.

4. The safety device as claimed in claim 1, wherein said support structure is a metal pipe, an outer surface of which substantially corresponds in shape and diameter to a shape and diameter of an inner surface of a vertical pipe of the well in such a manner that the support structure is lowerable inside the vertical pipe of the well.

5. The safety device as claimed in claim 1, wherein the safety device comprises a cover, with which access through the support structure to the well is closable.

6. The safety device as claimed in claim 1, wherein the support structure, the collar and protective dome-shaped structure of the safety device are dimensioned to withstand a direct collision by a passenger car with the protective dome-shaped structure without essentially comprising safety in said safe working area, when a speed of a passenger car during the direct collision is as defined by a prevailing speed limit on an installation site of the safety device.

7. The method of using the safety device as claimed in claim 1 in connection with the well on a street.

* * * * *